US006378798B1

(12) United States Patent
Kiriazaros

(10) Patent No.: US 6,378,798 B1
(45) Date of Patent: Apr. 30, 2002

(54) DEVICE FOR ENDLESS COILING OF STRIP MATERIAL

(75) Inventor: Kiriazis Kiriazaros, Graz (AT)

(73) Assignee: Voest Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/502,726

(22) Filed: Feb. 11, 2000

(30) Foreign Application Priority Data

Mar. 3, 1999 (AT) ..... 362/99

(51) Int. Cl.[7] ..... B65H 75/28

(52) U.S. Cl. ..... 242/532.2; 242/532.7; 242/533.7

(58) Field of Search ..... 242/531, 531.1, 242/532, 532.2, 532.7, 533.7, 533, 535, 547, 548

(56) References Cited

U.S. PATENT DOCUMENTS

| | | | | |
|---|---|---|---|---|
| 2,526,010 A | * | 10/1950 | Edstrom | 242/532 |
| 2,725,104 A | | 11/1955 | Wood | |
| 3,049,314 A | * | 8/1962 | Criger | |
| 3,100,605 A | * | 8/1963 | Bond | 242/532 |
| 3,880,374 A | * | 4/1975 | Reiser | 242/531 |
| 4,942,620 A | * | 7/1990 | Wilsch et al. | |
| 5,011,093 A | * | 4/1991 | Mayer et al. | |
| 5,335,713 A | | 8/1994 | Hoppmann et al. | 164/441 |
| 5,713,534 A | * | 2/1998 | McClenathan et al. | |
| 5,921,498 A | | 7/1999 | Wessel et al. | 242/533.6 |
| 5,967,448 A | * | 10/1999 | Berry et al. | 242/531.1 |

FOREIGN PATENT DOCUMENTS

| | | |
|---|---|---|
| DE | 1248602 | 8/1967 |
| DE | 3731748 A1 | 6/1989 |
| EP | 0145029 A2 | 6/1985 |
| EP | 0406249 | 1/1991 |
| EP | 0773178 | 5/1997 |

* cited by examiner

*Primary Examiner*—Katherine A. Matecki
(74) *Attorney, Agent, or Firm*—Ostrolenk, Faber, Gerb & Soffen, LLP

(57) ABSTRACT

A device for endless coiling of strip material has a support and two coil drums which are spaced from one another and move synchronously along the support in opposite directions. The first and second coil drums are displaced alternately to an initial position, wherein each of these drums rotates to receive a leading edge of a respective coil of strip material. Thereafter, each of the coil drums is displaced to a respective finish position where the coil drums each receive the remainder of a respective coil. The finish positions are spaced from the initial positions in opposite directions. The first and second coil drums are displaced alternately to a coil removal position, at which a respective wound coil of strip material is removed from each of the coil drums.

19 Claims, 4 Drawing Sheets

DEVICE FOR ENDLESS COILING OF STRIP MATERIAL

FIELD OF THE INVENTION

The invention relates to a device for endless coiling of strip material to form a plurality of coils, preferably of hot-rolled sheet metal in the hot state, onto a one coiler drum from two coiler drums, which are arranged at a constant distance on a supporting fixture and can each be rotated by means of a dedicated drive fixture to move synchronously, but alternately, from an initial coiling position to a coil removal position, and to an associated method.

BACKGROUND OF THE INVENTION

Casting of steel using the continuous casting process followed by on-line rolling results in the formation of an endless strip, the length of which is generally such that it is no longer possible for this endless strip to be wound into a single coil. For example, if a casting ladle with a capacity of 95 t is used for casting, the strip which is formed has to be wound into at least three coils.

When coiling an endless strip in a plurality of coils, it is necessary for the strip to be cut in accordance with the permissible coil weight and to be coiled alternately on two or more coiling devices to form coils. In this context, it is known for the endless strip to be cut after finish coiling of a first coil and for the new strip start formed in this way to be guided via guide devices and switches to a second coiling device which is still empty. At high strip speeds, a very complicated mechanism is required to ensure safe guidance of the strip.

To avoid such complex strip guidance systems, it is known (EP 0,773,178 A1 and EP 0,406,249 B1) to use so-called carousel coiling, in which two coiler drums are arranged at the end sides of a vertical support plate. As a result of rotation of the support plate, the axis of rotation of which is horizontal, the coiler drums are moved from a coiling position into a release position. If, in such arrangements, the rotary drive for the coiler drums is arranged in a stationary position, an extremely complex mechanical drive fixture is requited to drive the coiler drums, which adopt different three-dimensional positions.

According to EP 0 773 178 A1 each drum has its own drive, which is arranged on a support plate or a parallel further support plate which rotates synchronously with the support plate. However, this arrangement has the drawback that the electrical connections for the drive motors are difficult to establish; owing to the high weight of the coils, drive powers of up to 1000 kW are required. In accordance with the latest prior art, the electrical energy has to be transmitted via sliding contacts, since it is necessary for the carousel coiler to rotate through over 360°. Transmitting electrical energy to this extent is not only complex, but often also causes faults which have a particularly adverse effect on endless coiling. It is then necessary for the rolling mill to be shut down, which of course considerably impairs the quality of the strip.

SUMMARY OF THE INVENTION

The object of the invention is to avoid these drawbacks and difficulties and to provide a device of the type described in the introduction which enables strip material to be coiled endlessly in a plurality of coils in a simple manner and without high mechanical outlay. Still another object of the invention is to provide a device in which the electric power can be easily transmitted. Still a further object of the invention is to provide a device having a high level of operating reliability.

According to the invention, these objects are achieved by the fact that the coiler drums can each be moved from an initial coiling position in different directions to a respective finish coiling position.

The finish coiling positions are at a distance from both the initial coiling position and the coil removal position and are arranged in such a manner that, when one coil is in the finish coiling position, the other is in the initial coiling position. With such a design of the device, it is possible to move the drums from the initial coiling position into a finish coiling position and then into a coil removal position using reciprocating movement of the drums, so that the electrical energy can be supplied to the drive motors of the drums via movable cables. In addition, the coil removal position can be optimally located, so that the initial coiling position for the drum from which the coil which has been finish-coiled has just been removed can be reached in a very short time, if the coil removal position is not in any case identical to the initial coiling position. device, it is possible to move the drums from the initial coiling position into a finish coiling position and then into a coil removal position using reciprocating movement of the drums, so that the electrical energy can be supplied to the drive motors of the drums via movable cables. In addition, the coil removal position can be optimally located, so that the initial coiling position for the drum from which the coil which has been finish-coiled has just been removed can be reached in a very short time, if the coil removal position is not in any case identical to the initial coiling position.

Preferably, the initial coiling positions are identical for both coiler drums, i.e. there is only a single initial coiling position, making the device according to the invention particularly easy to operate.

According to a preferred embodiment, the coil removal positions are also identical for both coiler drums, i.e. there is also only a single coil removal position, so that a single coil removal device, which in this case may be arranged in a stationary position, will be sufficient.

A particularly simple design of the device is produced if the initial coiling positions are identical to the coil removal positions. A preferred variant is characterized in that only a single initial coiling position and a single, identical coil removal position is provided for both coiler drums.

In terms of motion engineering, a particularly simple solution for the device according to the invention is produced if both the finish coiling positions and the initial coiling positions and the coil removal positions lie in a single plane.

In this case, the plane is preferably arranged at an angle to the horizontal, the plane expediently including an angle of between 30 and 60°, preferably an angle of between 40 and 45°, with the horizontal.

A particularly simple operating method or design of the device is produced if for each of the coiler drums the initial coiling position is located centrally between the finish coiling positions and is identical to the coil removal position, a coil removal device being provided vertically underneath the initial coiling position and the coil removal position.

A preferred variant is characterized in that the coiler drums are arranged at an axial distance from one another on a supporting frame, which can be adjusted by means of a movement fixture, taking the coiler drums from an initial coiling position to a finish coiling position or to a coil removal position.

Preferably, a dedicated drive fixture and dedicated pressure rollers are provided on the supporting frame for each coiler drum.

If the coiler drums are designed as expanding mandrels, it is advantageous to provide an auxiliary initial coiling device, in which case advantageously the auxiliary initial coiling device, which is designed, for example, as a roll cage coiler or as a belt or chain coiler, can be moved, by means of an adjustment device, into an assist position, in which it engages around a coiler drum, and into a waiting position, which is at a distance from the assist position, preferably below or behind the plane formed by the supporting frame, and vice versa.

A method according to the invention for the endless coiling of strip material to form a plurality of coils, preferably of hot-rolled sheet metal in the hot state, onto two coiler drums which can each be driven by means of a dedicated drive, the coiler drums being moved synchronously, but alternately, in opposite directions between an initial coiling position and a coil removal position, is characterized in that a first coiler drum is moved from the initial coiling position into an associated, dedicated finish coiling position as soon as the initial coiling on the first coiler drum has taken place, after which a coil undergoes finish coiling, the strip material is cut and a new strip start which is formed in this way is guided to the second coiler drum, which in the meantime has been moved into the initial coiling position, where initial coiling of the strip material takes place, whereupon the second coiler drum, supporting the coil which has just undergone initial coiling, is moved into a dedicated finish coiling position, which differs from the finish coiling position assigned to the first coiler drum, where the coil undergoes finish coiling, during which period the coil which has previously undergone finish coiling on the first coiler drum is moved to the coil removal position, where it is removed, and the coiler drum which is then empty is moved into an initial coiling position, and in that the cycle is then repeated.

BRIEF DESCRIPTION OF THE DRAWINGS

The invention will now be explained in more detail with reference to an exemplary embodiment illustrated in the drawing in which.

DETAILED DESCRIPTION

Figure 1:
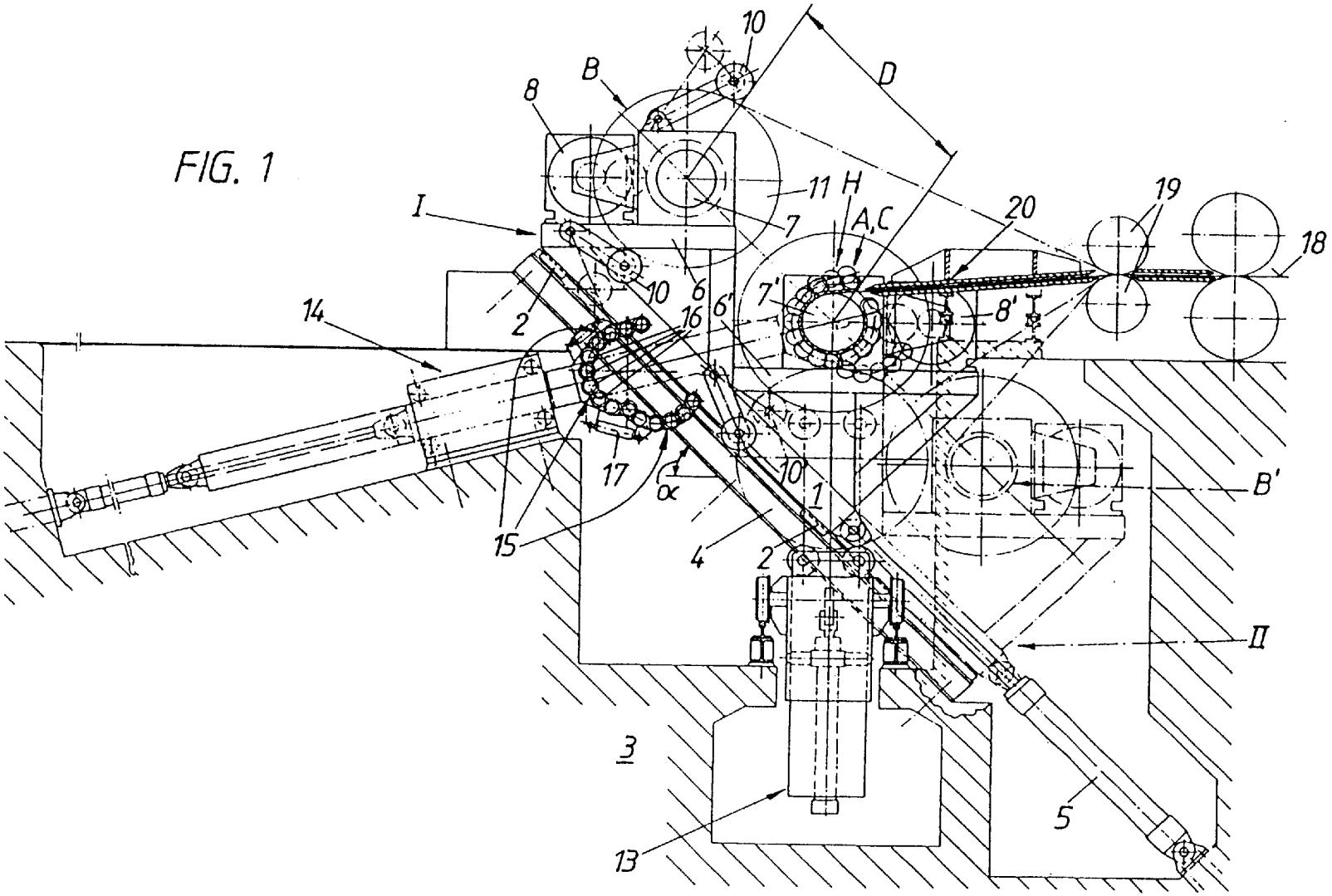
FIG. 1 shows a side view of the device according to the invention.

The device according to the invention has a supporting frame 1 which can be moved in a reciprocating manner by means of, for example, linear guides 2, rollers or guide shoes, etc. on guide rails 4, which are mounted on a slope on a base 3 and preferably include an angle of between 40 and 45° with the horizontal. The supporting frame 1 is moved by a drive mechanism, preferably a hydraulic pressure cylinder 5, which is articulatedly mounted on the base 3, at one end, and on the supporting frame 1, at the other end.

On each of two brackets 6, 6' the supporting frame 1 supports coiler drums 7, 7', the dedicated drive motors 8, 8' of which are also arranged on the respective brackets 6, 6'. Each coiler drum 7, 7' can therefore be driven by its own dedicated drive motor 8, 8'. The electrical power to the drive motors 8, 8' is supplied by flexible power leads 9, 9'.

Furthermore, each bracket supports pressure rollers 10, 10', in order to prevent a coil 11 which has been finish-coiled from springing open. The coiler drams are arranged with their axes 12, 12' in a plane which is parallel to the plane of the supporting frame 1 or the plane which is formed by the guide rails 4 and at distance D from one another.

The supporting frame 1 can be moved in a reciprocating manner between two positions I and II; in the upper position I of the supporting frame 1, the lower coiler drum 7' adopts an initial coiling position A and the upper coiler drum 7 adopts a finish coiling position B. This position is illustrated in solid lines in FIG. 1. In the lower limit position B of the supporting frame 1 (shown in dot-dashed lines in FIG. 1), the upper coiler drum 7 adopts the initial coiling position A, and the lower coiler drum 7' is situated in the finish coiling position B'.

Figure 2:
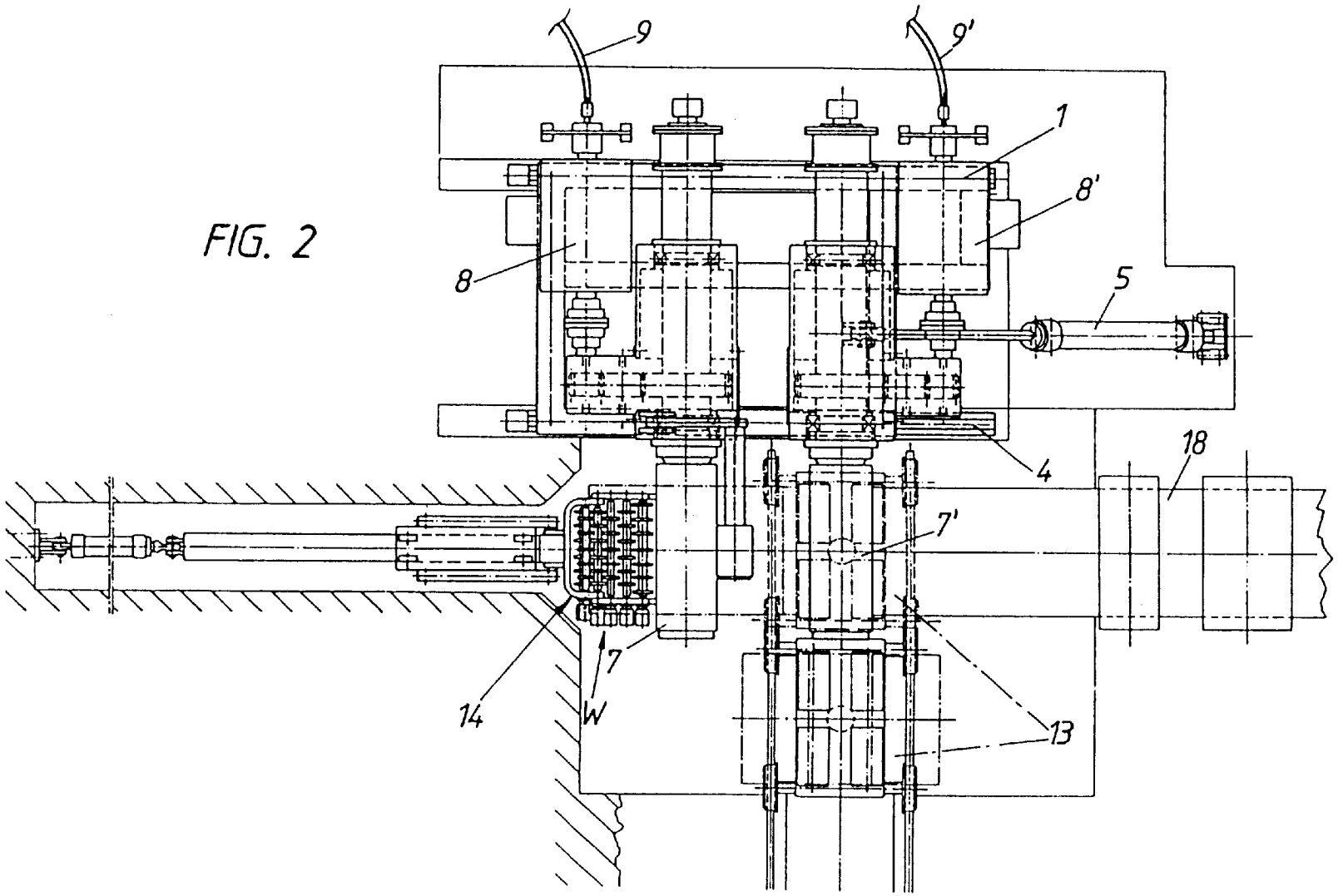
FIG. 2 shows a plan view of the device and FIG. 3 shows a view in the direction of arrow III from FIG. 2.
Figure 3:
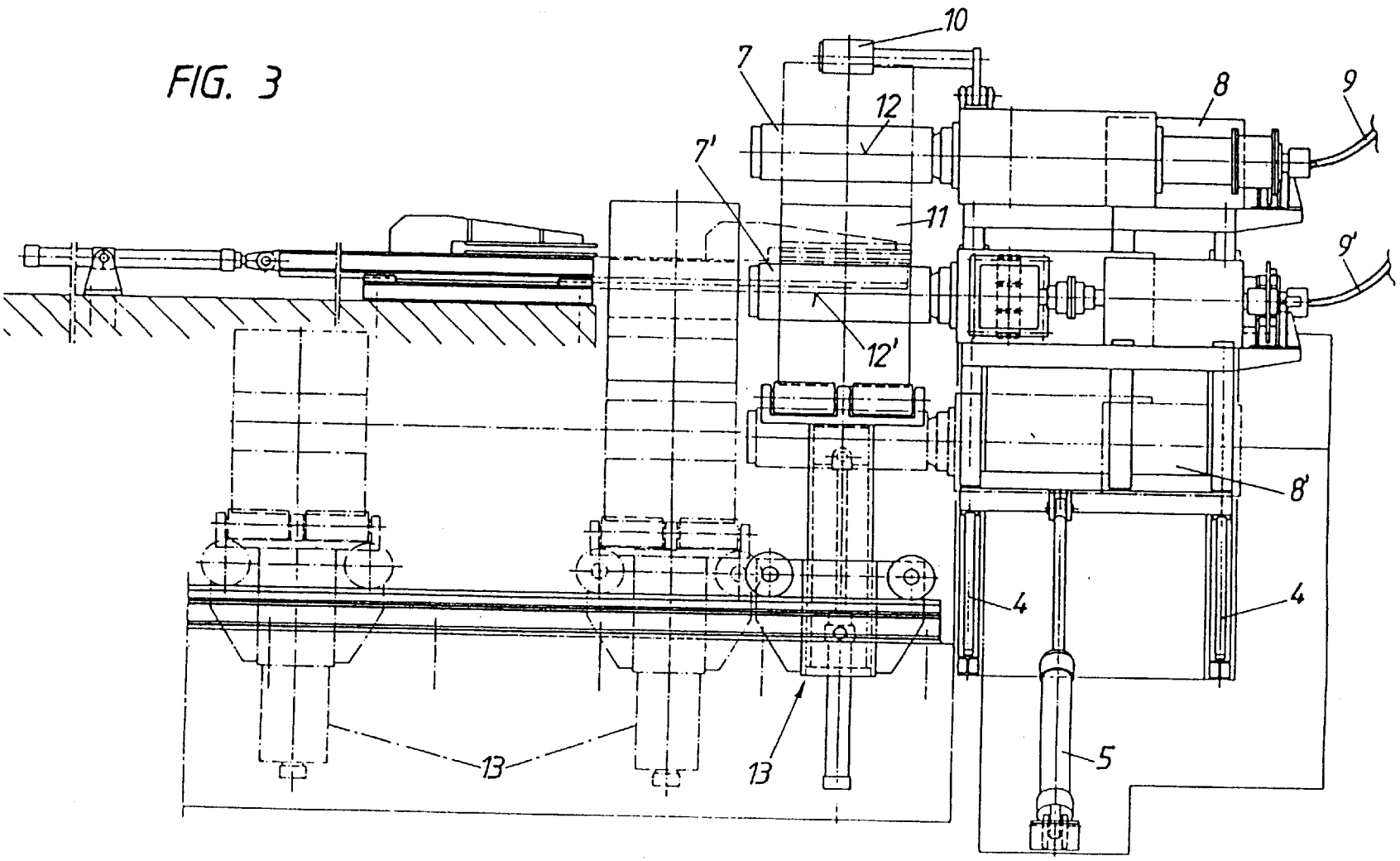

The initial coiling position A is identical to a coil removal position C. To remove the coil, a coil removal device 13 of standard design is provided exactly below the initial coiling position A. This coil removal device 13 can pull the coil 11 off the coiler drum 7 or 7' and convey it onwards, as illustrated by dot-dashed lines in FIGS. 2 and 3.

An auxiliary initial coiling device 14 can be moved, by means of an adjustment device, which is preferably designed as a hydraulic pressure cylinder, from a waiting position W, which lies below or behind the plane formed by the supporting frame 1 and is shown in solid lines in FIG. 1, into an assist position H, in which it surrounds one of the coiler drums 7, 7' which are in the initial coiling position A. The assist position H is illustrated by dot-dashed lines in FIG. 1.

In FIG. 1, the auxiliary initial coiling device 14 used is a roll cage coiler which is known per se and has a plurality of segments 15 and cage rollers 16, which are placed against the coiler drum 7, 7' in such a manner that the cage, which is formed from at least three segments 15 which can be pressed onto the strip 18 which is to be coiled and runs in a straight line by means of hydraulic cylinders 17, surrounds the coiler drum 7 or 7' over as much of its circumference as possible. Each of the segments 15 has a plurality of cage rollers which can be driven so that the strip 18 is actually guided securely during the first three turns. The cage rollers may also be driven by friction if they are pressed against the rotating coiler drum. After a few turns have been wound on, the coiler drum 7 or 7' is expanded and the coiler drum 7 or 7' begins to exert tension.

Figure 4:
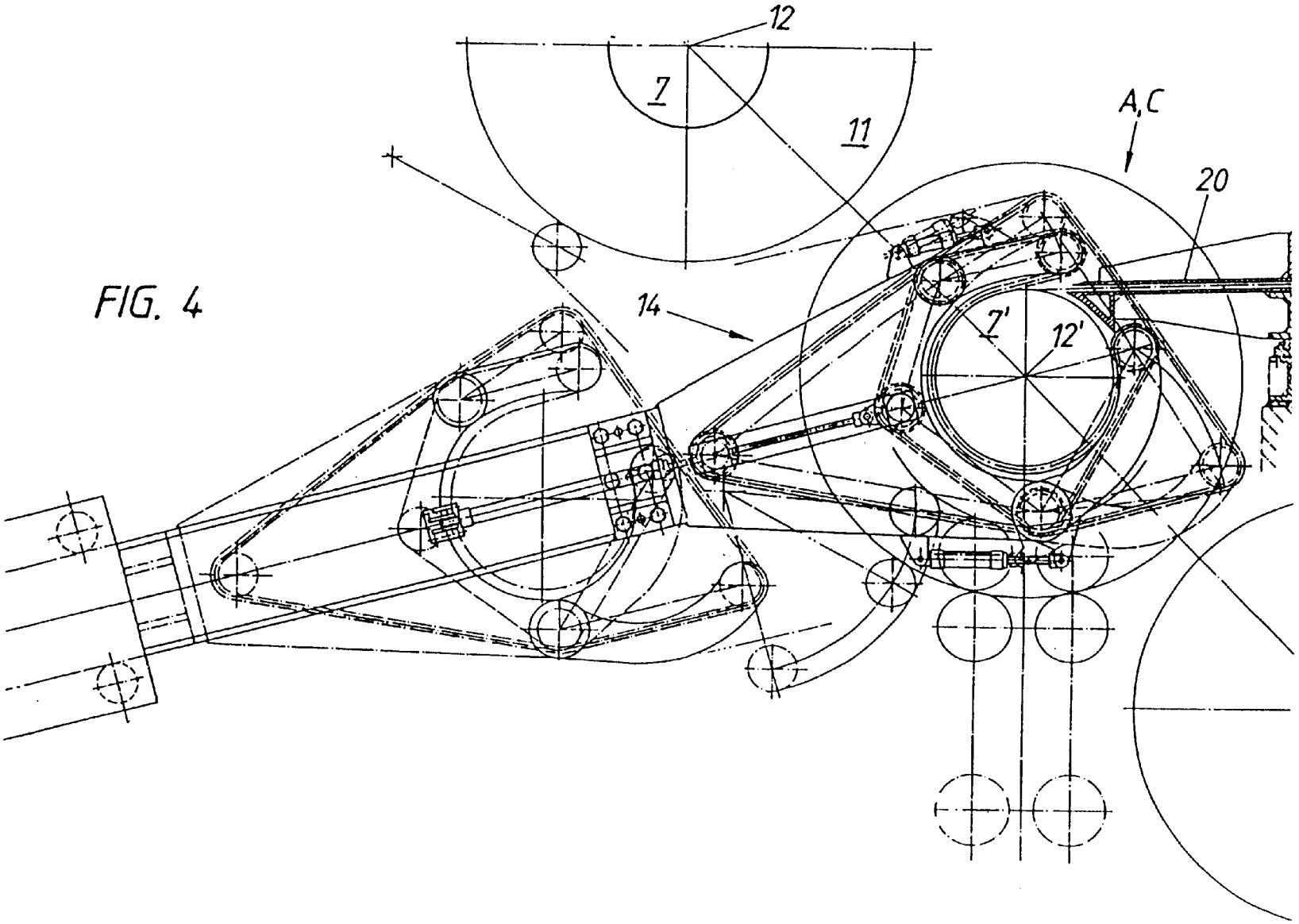
FIG. 4 illustrates a detail from FIG. 1 on an enlarged scale and according to a further variant design.

As an alternative to a roll cage coiler, it is also possible to provide belt or chain coilers (DE 1 248 602 B), which are known per se, for the initial coiling. In the case of a chain coiler, for example, a chain is guided over a plurality of rolls, which rolls are arranged on pivot arms, as illustrated in FIG. 4. After this auxiliary initial coiling device 14 has been placed against the drum coilers, the pivot arms are pivoted in, so that the chain substantially wrap around the coiler drum 7 or 7' and the first turns of the strip 18. In this case, the chain is driven by the friction generated as a result of its being wrapped around the coiler drum 7 or 7' or the strip 18. However, it is also possible for the chain or the strip 18 to be driven separately, for example through driving one or more sprockets.

Behind the final driver unit 19, which removes the strip 18 which has undergone finish-rolling, there projects an entry guide 20 which is mounted on the base 3 in such a manner that it can pivot or be displaced in linear fashion, leading to the coiler drum 7 or 7' which is at that instant in the initial coiling position A.

In front of the device according to the invention, there are flying shears of standard design, which are not shown in more detail.

The device according to the invention functions as follows:

For initial coiling of a first coil 11, the supporting frame 1 is displaced in such a way that one of the two coiler drums 7, 7' is in the central initial coiling position A. The strip 18 is guided onto the coiler drums 7, 7' via the entry guide 20, which can be pivoted or displaced in linear fashion, of the last driver 19, and a few turns are wound on. During this process, the auxiliary initial coiling device 14 presses the strip 18 firmly onto the coiler drum 7, 7' in a securing manner during the first three turns. The coil 11 is then coiled further. During coiling, i.e. shortly after initial coiling, the supporting frame 1 is displaced in such a way that the other coiler drum 7, 7' moves into initial coiling position A. For this purpose, therefore, the supporting frame 1 is moved either upwards or downwards, depending on which of the coiler drums 7, 7' commenced coiling.

If the coiling of the coil 11 on the coiler drum 7 or 7' which has been moved into finish coiling position B has finished, the strip 18 is cut and the pressure rollers 10 are placed against the coil 11, in order to prevent the coil 11 from springing open. The new strip start which is formed as a result of cutting of the strip 18 is fed to the second coiler drum 7, 7' which has already been moved into initial coiling position A, and undergoes initial coiling as described above. While the second coiler drum 7, 7' is then coiling, the supporting frame 1 is displaced in such a manner that the first coiler drum 7 or 7', together with the coil 11 which has undergone finish coiling, moves into the coil removal position C (which is identical to the initial coiling position A). The coil removal device 13 then removes the coil 11, after the expansion of the coiler drum 7 or 7' supporting the coil 11 has been eliminated and the pressure rollers 10 have been released. The coil 11 is lifted and removed sideways. During this operation, the coiling of the second coil 11 is finished. It is then possible for a new cycle, as described above, to begin.

As an alternative to the supporting frame 1, it would also be conceivable to use other guide devices for moving the coiler drums 7, 7' and their drives 8, 8', for example four-bar mechanisms or pivoting devices. The important factor is that the coiler drums 7, 7' only have to be moved to and for between the initial coiling position A and the finish coiling position B or B' and the coil removal position C. In this context, the movement of the coiler drums 7, 7' does not necessarily have to be in a single plane, although this does constitute an embodiment which is particularly simple to implement in technical terms.

Naturally, the device according to the invention can also be used for coil-on-coil winding (with waiting times between the individual coil winding operations).

What is claimed is:

1. A device for endless coiling of strip material to form a plurality of coils, each coil having a respective leading edge and trailing edge, the device comprising:

a support;

first and second coil drums spaced from one another on the support and displaceable together in opposite directions along the support such that displacement of the drums in one of the directions moves the first drum to a first initial position and moves the second drum to a respective second finish position spaced from the first initial position, and displacement of the drums in the opposite direction moves the second drum into a second initial position and moves the first drum to a respective first finish position spaced from the at least one initial position;

each of the first and second drums being rotatable to receive the leading edge of a respective coil while the drum is in the respective first or second initial position and to continue winding the coil in the first and second finish positions of the drums, respectively;

the first and second coil drums being alternately displaceable from the respective first and second finish positions to a respective first and second coil removal position, at which a respective wound coil of strip material is removable from the respective one of the first and second coil drums.

2. The device as defined in claim 1, wherein the first and second initial positions coincide.

3. The device as defined in claim 2, wherein the first and second coil removal positions coincide.

4. The device as defined in claim 1, wherein the first and second coil removal positions coincide.

5. The device as defined in claim 1, wherein the first and second initial positions and first and second coil removal positions coincide and are all spaced from the first and second finish positions.

6. The device as defined in claim 1, further comprising first and second drives rotatably coupled with the first and second coil drums, respectively.

7. The device as defined in claim 1, wherein the first and second coil drums are displaceable linearly along the support in a travel plane, the first and second initial, coil removal and finishing positions lying in the travel plane.

8. The device as defined in claim 7, wherein the travel plane is at an angle which varies from 30° to 60° with respect to a horizontal.

9. The device as defined in claim 1, further comprising an initial coil support which is displaceable transversely to the travel plane and stoppable under each of the first and second coil drums in the first and second initial positions, respectively, to press the leading edge of a respective coil against a respective one of the first and second drums.

10. The device as defined in claim 1, further comprising a drive connected to the first and second coil drums to displace the first and second coiler drums along the travel plane.

11. The device as defined in claim 1, further comprising a first and a second pressure roller urgeable against the trailing edge of a respective coil of strip material and displaceable with a respective one of the first and second coil drums along the support to prevent a respective coil of strip material from uncoiling.

12. The device as defined in claim 1, further comprising a coil remover displaceable transversely to the travel plane to engage a respective one of the first and second coil drums in the first and second coil removal positions, respectively, to remove a respective coil of strip material wound on the first and second coil drums.

13. A method for endless coiling of strip material comprising the steps of:

(a) winding a leading edge of strip material on to a first coil drum which is in a first initial position;

(b) displacing the first coil drum in a first direction to a first finish position, and there winding a length of the strip material which follows the leading edge on the first coil drum;

(c) cutting the strip material after the length of the strip material has been wound on the first coil drum, thereby forming another leading edge of the strip material;

(d) simultaneously with step (b), displacing a second coil drum, which is spaced from the first coil drum, in the first direction to a second initial position, and there receiving the other leading edge of the strip material;

(e) displacing the first and second coil drums in a second direction opposite the first direction to move the first drum to a first coil removal position, and there removing the wound strip material from the first coil drum, and to displace the second coil drum to a second finish position, and there winding a length of the strip material which follows the other leading edge on the second coil drum;

(f) displacing the first and second coil drums in the first direction to bring the second drum to a second coil removal position, and there removing the wound strip material from the second coil drum.

14. The method as defined in claim 13, further comprising repeating the steps (a) through (f).

15. The method as defined in claim 13, wherein the first and second initial positions coincide.

16. The method as defined in claim 15, wherein the first and second coil removal positions coincide.

17. The method as defined in claim 13, wherein the first and second coil removal positions coincide.

18. The method as defined in claim 13, wherein the first and second initial positions and first and second coil removal positions coincide and are all spaced from the first and second finish positions.

19. The method as defined in claim 13, wherein the first and second coil drums are displaceable linearly along the support in a travel plane; the first and second initial, coil removal and finishing positions lying in the travel plane at an angle which varies from 30° to 60° with respect to a horizontal.

* * * * *